United States Patent [19]

Lincoln

[11] 4,277,126

[45] Jul. 7, 1981

[54] RELEASABLE KEY ARRANGEMENT FOR AN ELECTRICAL CONNECTOR

[75] Inventor: Thomas C. Lincoln, South Pasadena, Calif.

[73] Assignee: Malco, South Pasadena, Calif.

[21] Appl. No.: 75,219

[22] Filed: Sep. 13, 1979

Related U.S. Application Data

[63] Continuation-in-part of Ser. No. 5,907, Jan. 23, 1979, abandoned.

[51] Int. Cl.[3] ..... H01R 13/504

[52] U.S. Cl. ..... 339/186 M

[58] Field of Search ..... 339/92 M, 184 M, 186 M, 339/65, 66, 184 R, 186 R; 308/3 R, 4 R

[56] References Cited

U.S. PATENT DOCUMENTS

| | | | |
|---|---|---|---|
| 2,746,022 | 5/1956 | Gilbert | 339/92 M |
| 2,902,665 | 9/1959 | D'Amico | 339/92 M X |
| 2,903,668 | 9/1959 | Cornell, Jr. | 339/92 M X |
| 2,953,767 | 9/1960 | Jackson et al. | 339/92 M |
| 3,177,461 | 4/1965 | Hagen et al. | 339/184 M |
| 3,582,867 | 6/1971 | Thompson | 339/92 M |
| 3,714,617 | 1/1973 | Bright | 339/186 M |
| 4,032,213 | 6/1977 | Snyder | 339/186 M |

FOREIGN PATENT DOCUMENTS

| | | | |
|---|---|---|---|
| 1200910 | 9/1965 | Fed. Rep. of Germany | 339/184 M |
| 637413 | 5/1950 | United Kingdom | 151/41.72 |

*Primary Examiner*—John McQuade
*Assistant Examiner*—John S. Brown
*Attorney, Agent, or Firm*—Burns, Doane, Swecker & Mathis

[57] ABSTRACT

A releasable key arrangement for an edgeboard connector includes a support member having a bore extending completely through the support member. A polarizing key is mountable to the support member. A threaded retaining member is normally mounted in the key and threadedly connectible to the support member to connect the key thereto. Threads on the retaining member are short enough in the axial direction to be disposed externally of the key when the key has been connected to the support member. Alternatively, the retaining member can be rotatably mounted within the support member and constrained against axial movement, and is threadedly securable to the key. A leader pin and leader bushing are connectible to the connectors to assure proper alignment of contact elements during initial testing. The leader pin is automatically adjustable to a position of alignment with the leader bushing in response to initial connection of the connectors and is then fixed in place to maintain such position of alignment to facilitate subsequent reconnection of the connectors.

14 Claims, 12 Drawing Figures

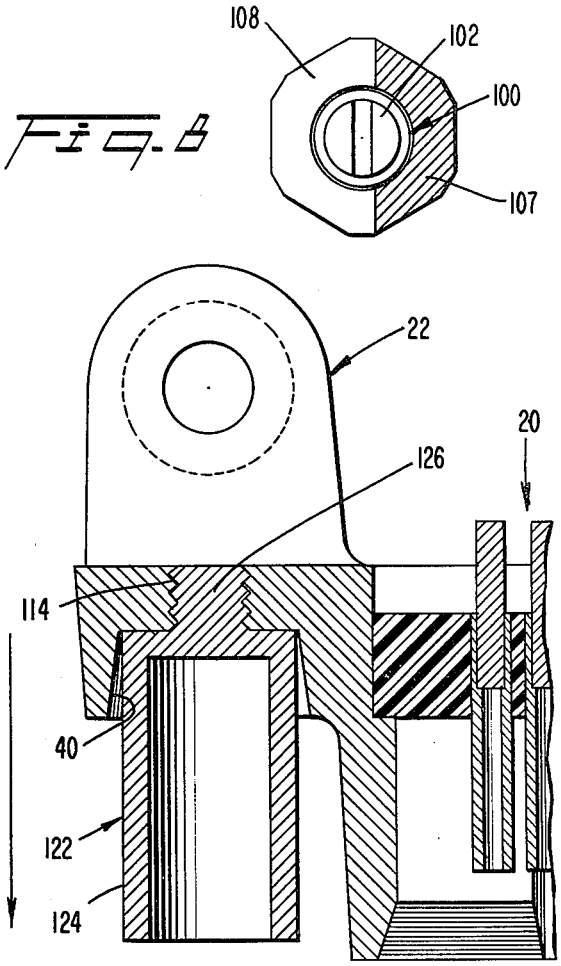
Fig. 8
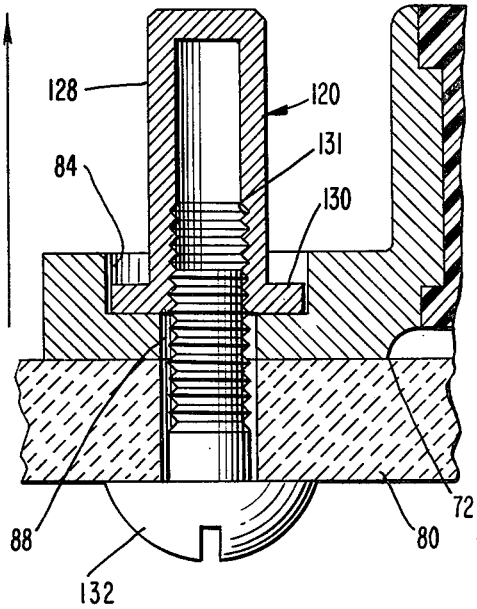
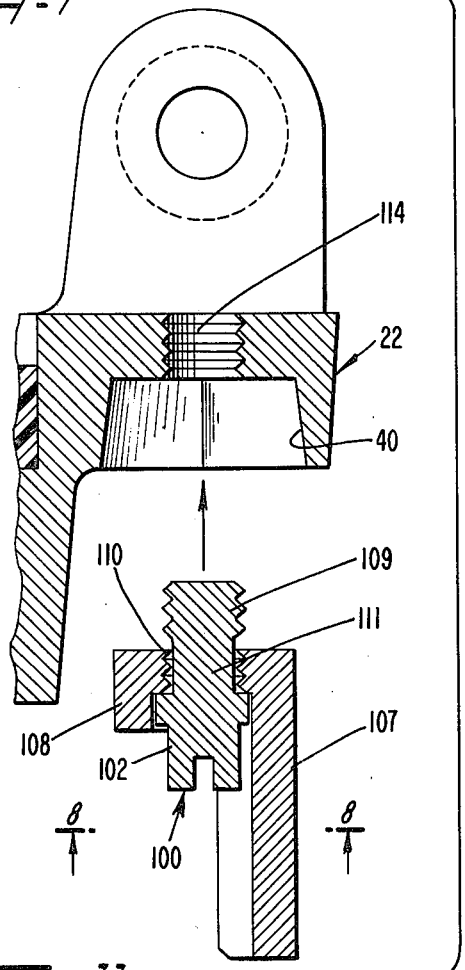
Fig. 7
Fig. 11
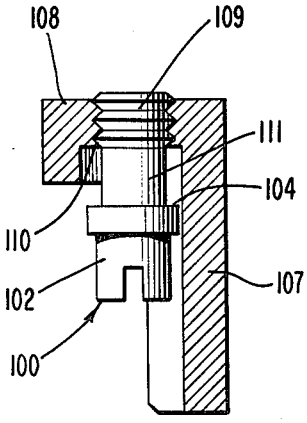
Fig. 10
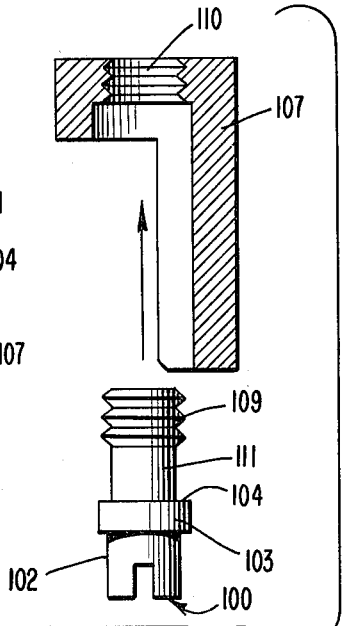
Fig. 9

RELEASABLE KEY ARRANGEMENT FOR AN ELECTRICAL CONNECTOR

RELATED APPLICATION

This is a continuation-in-part of U.S. Application Ser. No. 005,907 filed Jan. 23, 1979, now abandoned, by the present inventor.

BACKGROUND AND OBJECTS OF THE INVENTION

The present invention relates generally to electrical connectors and more particularly relates to polarization keys therefor.

Separable electrical connectors having corresponding electrical contacts are well known in the art. Typically, these electrical connectors are provided with polarizing keys or other polarization devices in order to prevent an improper mating of male and female electrical connectors. For example, the key of one connector may be of a three-sided configuration which mates with a corresponding three-sided key of another connector when properly oriented therewith, to form a resultant hexagonal arrangement.

The keys or polarizing members are mounted on the separable electrical connectors so that axially extending projections of one connector may mate with proper ones of the other connector during a joining of the connectors. Various arrangements are known in the art for mounting and polarizing members on the electrical connectors. Representative patents disclosing arrangements for mounting polarizing members on electrical connectors include U.S. Pat. Nos. 3,582,867 issued to Thompson et al on June 1, 1971; 3,714,617 issued to Bright et al on Jan. 30, 1973; 3,177,461 issued to Hagan et al on Apr. 6, 1965; 3,675,185 issued to Ruehlemann et al on July 4, 1972; and 3,426,315 issued to DeTar on Feb. 4, 1969.

All of the known methods for mounting the keys or polarization members on the electrical connects are undesirable for one or more reasons. For example, in one instance a key has been provided with a hexagonally-shaped base which seats within a corresponding hexagonally-shaped cavity in the connector, thus providing six selective positions of adjustment for the key. The key is fixed within the cavity by a pair of retaining pins which each extend through the connector housing and through the annular depression of the key. In particular, the connector housing includes two side-by-side pairs of aligned pin-receiving holes. Each pair of aligned holes intersects the key-receiving cavity and is adapted to receive one of the retaining pins by a pressure fit.

The hexagonal base of the key is interrupted by an annular grove. The grove is slightly wider than the diameter of the largest retaining pin. The minor diameter of the grove is less than the distance between the pairs of pin receiving holes in the connector housing. For each of the selected key positions the continuous grove provides an aperture for the retaining pins. Thus, each retaining pin can be installed within one of the pairs of aligned holes, with its middle section disposed within a grove of the key base. Accordingly, the key is held against axial displacement relative to the housing. Rotational displacement is limited by seating the hexagonally-shaped key into a hexagonally-shaped cavity in the housing previously described.

It is necessary that close tolerances be maintained for the holes and retaining pins thereby requiring significant fabrication cost and time. In this regard, the dimension of the holes for each retaining pin can readily be drilled to only one or two-thousandths of an inch tolerance. Nickel plating which is subsequently provided on the electrical connector has a thickness ranging from about one to three-thousandths of an inch. If the holes for receiving the retaining pins are initially too small or the subsequent plating is too thick, the holes must be redrilled and individually coated with a material, for example, gold iridite. Of course, it is preferable to have a fully unbroken nickel plating on the electrical connector if possible, and furthermore it is desirable to avoid the expense involved with redrilling and recoating the holes.

The use of retaining pins to maintain the key on the electrical connector is also desirable since the key cannot then be readily removed and repositioned. Such a removal and repositioning of the key is oftentimes desirable in order to permit one electrical connector to mate with a different electrical connector.

In other known arrangements for mounting a key or polarizing member on an electrical connector, the key is provided with a threaded shaft which extends completely through the electrical connector. A nut is then threaded onto the end of the shaft to retain the key on the connector. In such an arrangement, the nut must be rotated which typically requires that the connector be disassembled from a daughterboard before the key can be removed.

In a further known arrangement, and depicted herein in connection with FIG. 3, a screw may be loosely positioned within a bore of the connector for threadably securing the key in place. However, the screw is to receive a tool from an end thereof which is opposite the end to which the key is connected. Accordingly, the tool-receiving side of the connector must be accessible to the tool which is not always possible or convenient.

In another known arrangement, the key is frictionally received within a depression of the electrical connector. In such an arrangement, the keys may have a tendency to separate from the electrical connector inadvertently.

In still another arrangement, a retaining ring axially fixes the key with respect to the electrical connector. Such a retaining ring is difficult to position and remove.

Prior to the actual installation of the electrical connectors, it is desirable to perform tests therein in which the connectors are repeatedly detached and recoupled. During such operations, there exists the danger that elements of the contact assembly may become bent if the contacts of one connector are not truly aligned relative to those of the other connector. It has been known in the case of some types of connectors, other than edgeboard connectors, to employ leader sleeve and leader pin elements which are fixedly connected to respective connectors and which mate when the connectors are joined, to assure that proper alignment between the contacts occurs. However, in order to compensate for dimensional tolerances, the sleeve is usually oversized to assure that mating between the pin and sleeve can occur when slight misalignment of such sleeve and pin elements exists. Of course, the presence of such oversizing somewhat defeats the original purpose of providing the leader pin and sleeve since the sleeve and pin elements may thus permit slight misalignment to occur between the connectors.

It is, therefore, an object of the present invention to minimize or obviate problems of the sort discussed previously.

It is a further object of the present invention to provide novel methods and apparatus for properly orienting and aligning electrical connectors.

It is another object of the present invention to provide a releasable key arrangement for an electrical connector wherein a polarization key is readily attached to a support member by a threaded retaining member.

Another object of the present invention is to provide a releasable key arrangement wherein removal of the key from a support member may be achieved by rotation of a threaded retaining member which is rotatably mounted on the support member or on the key.

Yet still another object of the present invention is to provide a key arrangement for an edgeboard connector wherein a key may be rigidly mounted on the edgeboard connector but readily released when desired to permit a repositioning of the key on the edgeboard connector.

It is an additional object of the invention to provide novel methods and apparatus which enable a leader pin and leader sleeve to be automatically aligned in response to the interconnection of associated connectors and thereafter maintained in alignment.

SUMMARY OF THE INVENTION

These objects are achieved by the present invention which involves a releasable polarizing arrangement for a connector which carries a support member. The polarizing arrangement comprises a polarizing key adapted for securement to a side of the support member, and a retainer for releasably securing the key to the support member. The retainer includes securing structure for normally positively mounting the retainer to one of the key and support member for rotation relative thereto, and for positively connecting the retainer to the other of the key and support member in response to rotation of the retainer, to secure the key to the support member. The retainer includes means accessible from said side of the support member for rotating the retainer.

The retainer may be normally mounted to the key by threads on the retainer, or to the support member by a connection which allows rotation of the retainer without axial displacement.

In an independently significant aspect of the invention, a leader pin/sleeve assembly is provided for aligning first and second interconnectible electrical connectors carrying contact assemblies. The leader pin is receivable within the sleeve when the connectors are interconnected. One of the sleeve and pin is fixedly mounted to one of the connectors. The other of the sleeve and pin is loosely mounted within a bore of the other connector for being automatically adjusted to a position of alignment relative to said one of the sleeve and pin in response to interconnection of the connectors. Means is provided for fixedly mounting said other of the sleeve and pin to said other connector when the pin is received in the sleeve, to maintain the position of alignment.

BRIEF DESCRIPTION OF THE DRAWING

Other objects and advantages of the present invention will become apparent in the subsequent description of a preferred embodiment thereof with reference to the accompanying drawings, wherein like members bear like reference numerals and wherein:

FIG. 7 is an exploded sectional view of the embodiment depicted in FIG. 6, showing the retainer mounted in the key and being brought toward a support member;

FIG. 8 is a cross-sectional view taken through the key along line 8—8 in FIG. 7;

FIG. 9 is an exploded view showing the retainer being introduced into the key;

FIG. 10 is a sectional view through a key depicting another manner of mounting the retainer therein; and FIG. 11 is a view similar to FIG. 3 depicting a leader pin/sleeve assembly being brought together.

DETAILED DESCRIPTION OF THE PREFERRED EMBODIMENT

Figure 1:
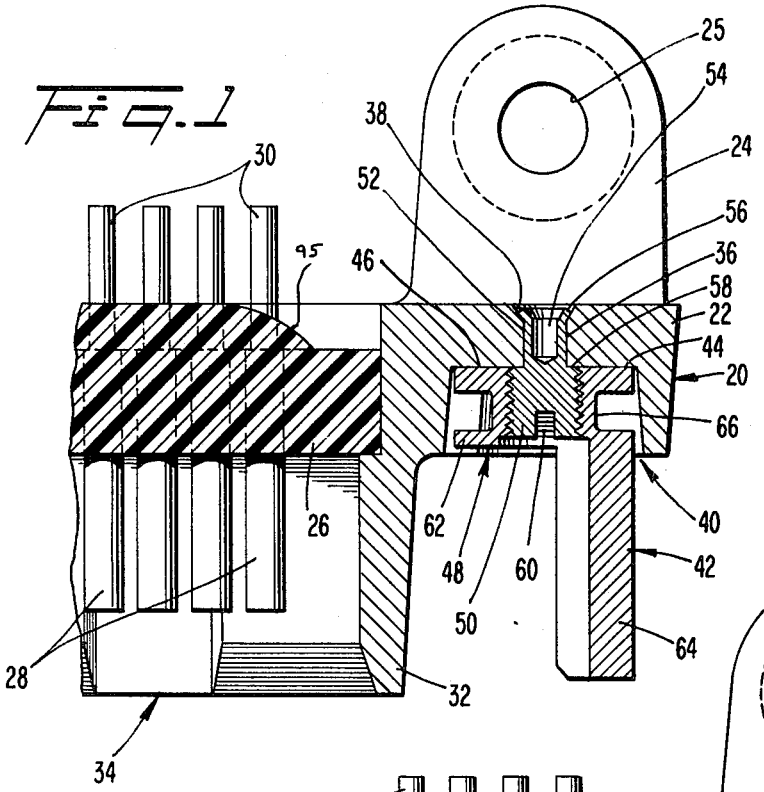
FIG. 1 is a partial cross-sectional view of a first embodiment of a releasable key arrangement on an edgeboard connector, according to the present invention.

In accordance with the present invention, an edgeboard electrical connector 20, which may be of conventional design, includes a metallic support member 22 which is of generally rectangular cross-section with mounting arms 24 at either end. The mounting arms 24 (only one of which is shown in FIG. 1) are each provided with a bore 25 to permit the attachment of the connector to a daughterboard (not shown). Only one end of the electrical connector is illustrated in FIG. 1 since the other end of the electrical connector is preferably identical in construction with the illustrated end of the electrical connector with regard to the present invention.

The electrical connector 20 includes a non-conductive plate member 26 which receives a plurality of electrical contacts 28. Each of the electrical contacts 28 is tubular in shape and is terminated with a solid conductor wire 30 which is formed and tinned. The solid conductors 30 are soldered to the electrical conductors on the daughterboard. The plate member 26 positions the contacts 28 and wires 30 and provides electrical isolation therebetween. Contact retention is assisted with epoxy potting material 95. The construction and arrangement of the contact assemblies 28 and 30 and the insulator 26 on the electrical connector 20 is conventional and well known in the art.

The electrical connector 20 includes an outer wall 32 which encircles the plurality of tubular members 28. The wall 32 may be rounded at one end and square at another end so as to assure a correct orientation of the electrical connector 20 with a cooperating electrical connector (see FIG. 3) during mating of the connectors as is conventional. Furthermore, a guide or slot 34 may be provided in a known manner on an inner surface of the wall 32 which corresponds to a raised portion of another electrical connector (not shown) during mating.

A first embodiment of a releasable key arrangement according to the present invention will now be discussed with reference to FIGS. 1 to 5*b*. In that regard, a bore 36 is provided in an end portion of the support member 22 and extends completely through the end of the support member. The bore is counterbored at an end thereof adjacent the mounting arms 24 to provide a frusto-conical annular shoulder 38 for the bore 36. A hexagonal depression or cavity 40 is disposed in the support member 22 concentrically with the bore 36 to provide a receptacle for a key 42. The key 42 has a hexagonal periphery which is slightly smaller than the cross-section of the depression 40. Furthermore, the depression 40 has a flat bottom surface 44 so that a bottom surface 46 of the key 42 may readily abut the bottom surface of the depression 40.

A threaded retaining member 48 has a cylindrical portion 50 and an axially projecting portion 52, the latter being of a smaller diameter than the cylindrical portion 50. The axially projecting portion 52 has a diameter which is slightly smaller than the diameter of the bore 36 so as to permit the threaded retaining member to freely rotate within the bore 36. The axially projecting portion includes a bore 54. The end of the axially projecting portion is conically deformed within the annular shoulder 38, whereby the conical deformation 56 of the axially extending portion corresponds in shape to the shoulder 38.

The cylindrical portion 50 of the threaded retaining member is provided with threads 57 throughout its entire length. An annular shoulder 58 is provided at the junction between the cylindrical portion 48 and the axially extending portion 52 which is sufficient in radial extent to cooperate with the annular deformation 56 in retaining the threaded retaining member on the support member. Sufficient play is provided between the threaded retaining member and the support member to permit free rotation of the threaded retaining member relative to the support member. A slot 60 extends across an outer end of the cylindrical portion 50 so as to permit rotation of the threaded retaining member by a tool such as a screwdriver (not shown). The slot 60 is accessible from a side of the retaining member into which the key is inserted. Instead of a slot, the cylindrical portion could have a socket head with multiple internal teeth. A hex drive wrench would then provide a rotational torque for turning the threaded retaining member.

The key 42 includes an annular base portion 62 and an axially projecting alignment portion 64. The annular portion 62 has a hexagonal outer periphery (see FIG. 4) and is provided with a central threaded bore 63 which corresponds to the threaded cylindrical portion 50 of the threaded retaining member 48. By placing the bore 63 of the key against the cylindrical portion 50 of the threaded retaining member 48 and rotating the latter, the key can be drawn into the cavity 40 via the threaded connection between the retaining member and the key. The annular portion 62 may include a circumferential depression 66 which permits the key 42 to be held in an alternative manner within the depression 40 by a pair of retaining pins (not shown) which extend through the support member on either side of the annular portion in a known manner.

Figure 4:
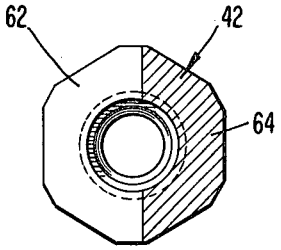
FIG. 4 is a cross-sectional view through the key taken along line 4—4 of FIG. 2.

The axially extending portion 64 extends from only one-half of the cross-sectional surface of the annular portion 62 (see FIG. 4). In the preferred embodiment the axially extending portion is three-sided, although other configurations are possible. In this way, the key 42 may mate with an identical key which is oriented in a corresponding manner on another electrical connector.

Figure 2:
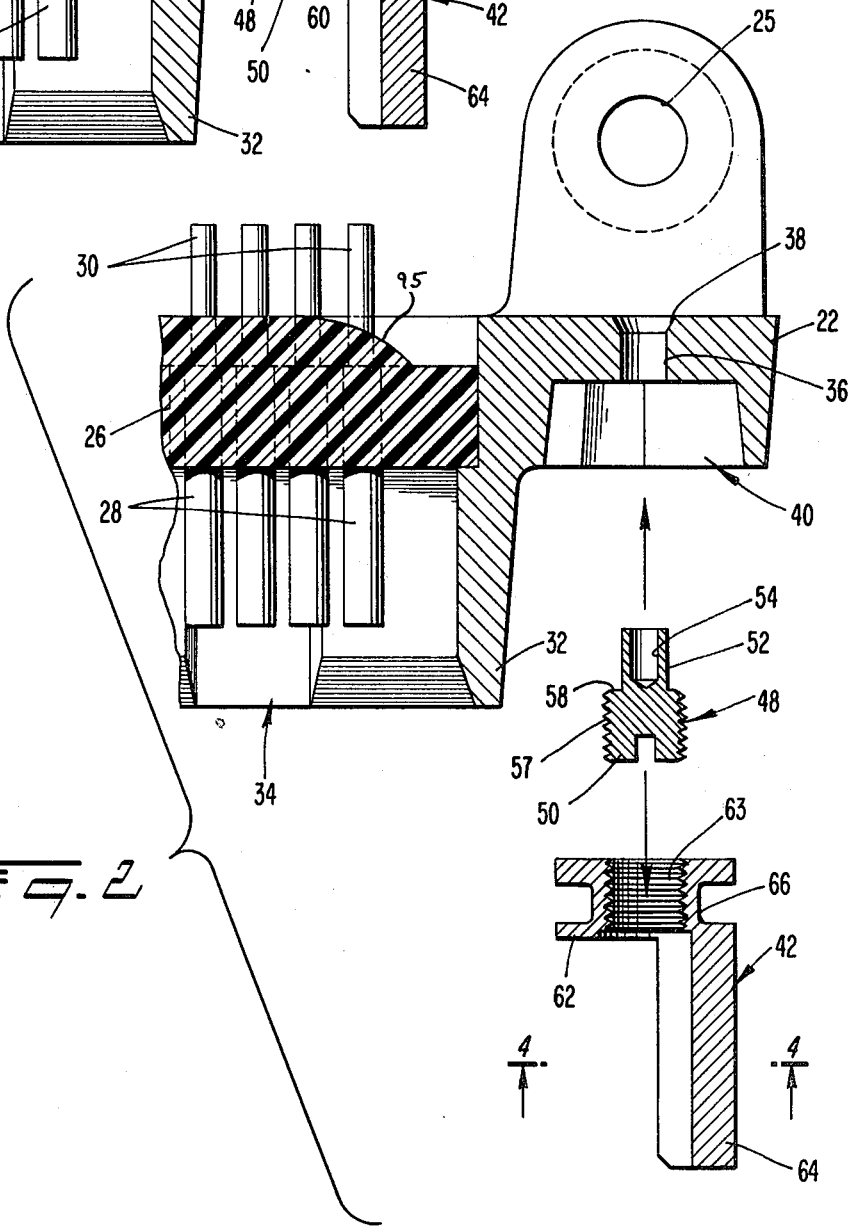
FIG. 2 is an exploded view of the key arrangement of FIG. 1 prior to deformation of a threaded retaining member thereof.
Figure 5A:
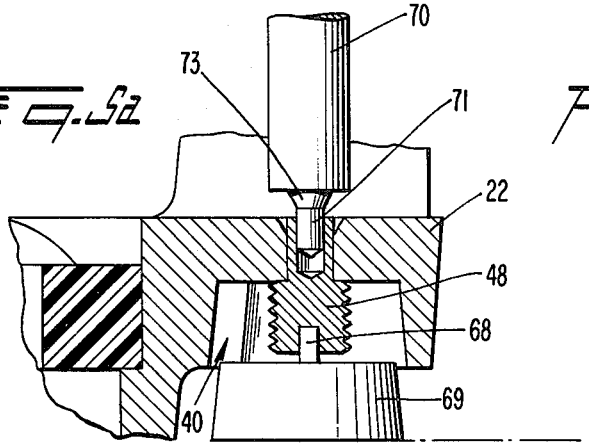
FIG. 5*a* is a partial longitudional sectional view of the key arrangement of FIG. 1 showing the insertion of the conical flaring tool into the bore of the threaded retaining member.
Figure 5B:
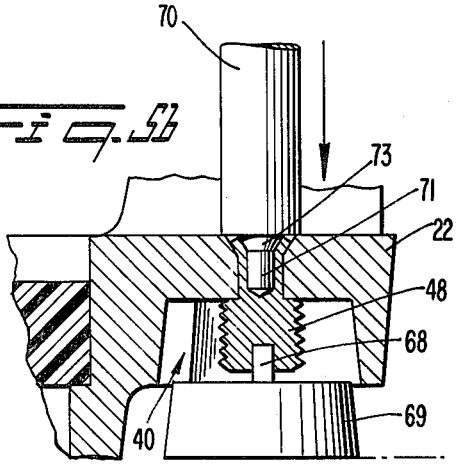
FIG. 5*b* is a view similar to FIG. 5*a* with the conical flaring tool fully inserted into the threaded retaining member.

The exploded view of the connector in FIG. 2 is particularly useful to illustrate the assembly of the key arrangement. After the support member 22 has been provided with the bore 36, the counterbore 38 and hexagonal depression 40, the axially projecting portion 52 of the threaded retaining member is inserted into the bore 36. With reference now to FIG. 5*a*, an arm 68 of a tool 69 securely supports the threaded retaining member 48 relative to the support member 22. A conical flaring tool 70 is provided having both a projection 71 which corresponds to the internal surface of the bore 54 and a frusto-conical flaring shoulder 73 corresponding to the annular shoulder 38 of the base 36. The tool 70 is urged downwardly into the bore 54 of the threaded retaining member whereby the flaring shoulder 73 deforms the end of the axially projecting portion 52 of the retaining member. The threaded retaining member is preferably made of a resilient material, most preferably spring steel, so that upon the withdrawal of the conical flaring tool, the annular deformation of the end of the axially projecting portion will permit a free rotation of the threaded retaining member, without axial displacement, on the support member. That is, the slight flexing of the spring steel back towards its undeformed configuration is sufficient to permit the free rotation of the threaded retaining member on the support member.

The threaded retaining member 48 may be rotatably mounted on the support member in other manners which will become readily apparent to one skilled in the art after consideration of the present invention. For example, the axially projecting portion of the threaded retaining member may extend beyond the upper surface of the support member. The end of the axially projecting portion may then be flattened in the configuration of a mushroom so as to rotatably mount the threaded retaining member on the support member. Other arrangements, for example, wherein a member having a diameter greater than the diameter of the bore 36 is welded to the axially projecting portion to retain the retaining member on the support member are also possible.

Figure 3:
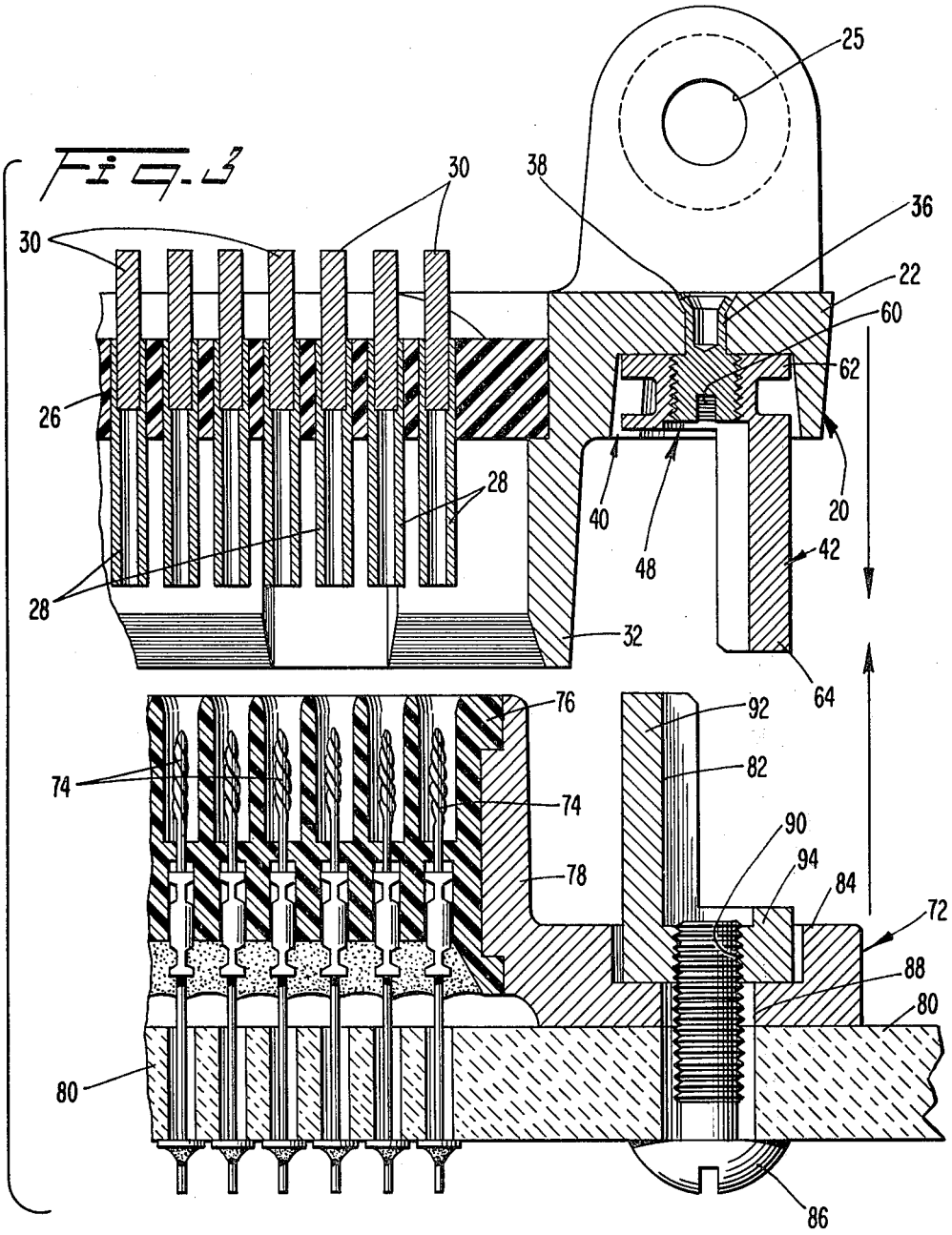
FIG. 3 is a partial cross-sectional view of the edgeboard connector of FIG. 1 and another edgeboard connector having a cooperating key arrangement immediately prior to mating of the connectors.

With reference now to FIG. 3, the edgeboard connector 20 of FIG. 1 including the releasable key arrangement according to the present invention may be mated with a corresponding electrical connector 72. The electrical connector 72 includes a plurality of electrical contacts 74 which are mounted in a non-conductive material 76. A wall 78 of the electrical conductor 72 has a configuration which corresponds to the wall 32 of the electrical connector 20. The wall 78 encircles the plurality of electrical connectors 74 and may be received within the wall 32.

The electrical connector 72 is mounted on a motherboard 80 with the electrical connectors 74 extending through the motherboard 80. A key 82 is on the connector 72 in a conventional manner. More particularly, the key is mounted within a corresponding depression 84 of the electrical connector 72 by a threaded bolt 86. The threaded bolt 86 extends through the motherboard 80 and through a bore 88 of the electrical connector 72 to threadably engage a bore 90 of the key 82. An axially extending portion 92 of the key 82 is connected to an annular portion 94 of the key. The axially projecting portion 92 extends only from a sector of the annular portion 94 and corresponds to the axially extending portion 64 of the key 42, whereby mating of the connectors 22, 72 is permitted.

In order to prevent the mating of the electrical connector 20 with the electrical connector 72, the key 42 should be oriented in a different position relative to the support member 22 and thus relative to the other key 82. The key 42 may be oriented differently by reversely rotating the threaded retaining member 48 to release the key 42 from the support member. After the key has been repositioned in a new orientation, the threaded retaining member is rotated so as to draw the key 42 back into the depression 40 of the support member 22. The electrical edgeboard connector 20 would then be available for a mating connection with yet another edgeboard connector (not illustrated).

In summary, then, the key 42 of the releasable key arrangement initially is selectively oriented relative to the support member 22 and positioned adjacent to an outer end of the threaded retaining member 48. The threaded retaining member is then rotated forwardly so as to draw the key 42 into the corresponding depression 40 of the support member. The electrical connector is positioned immediately adjacent to another electrical connector having keys which correspond to the keys of the first electrical connector. The electrical connectors are then urged together so that the electrical contacts engage one another and so that the corresponding keys mate with one another.

Another preferred embodiment of the releasable key arrangement is illustrated in FIGS. 6 to 10. In that embodiment a retaining member 100 is provided which is normally secured in the key. The retainer 100 comprises a slotted head 102, a portion 103 of enlarged diameter forming a shoulder 104, and an axially projecting stem portion 106. The slotted head portion 102 is adapted to receive a tool such as a screwdriver, for example, to rotate the retaining member 100.

A key 107 includes a hexagonal base 108 adapted to be received within the hexagonal depression 40 of the support member 22. The base 108 includes a bore 110 which is threaded in complementary fashion to a threaded outer section 109 of the stem portion 106 of the retaining member 100 so that the retainer member can be normally carried by the key 107 as depicted in FIG. 7 or FIG. 10 to prevent the retainer member from being lost or misplaced. The threads on the threaded stem section 109 terminate short of the shoulder 104 so that an unthreaded section 111 is formed on the stem 106 which is at least equal in length to the bore 110 of the key 107. The diameter of the unthreaded stem section 111 is slightly less than the smallest diameter of the threads of the bore 110 so that the unthreaded stem section 111 can rotate freely within the bore 110.

A bore 114 of the support member 22 is threaded in complementary fashion to the threaded stem section 109 so that the retainer 100 can be threadedly connected thereto.

Figure 6:
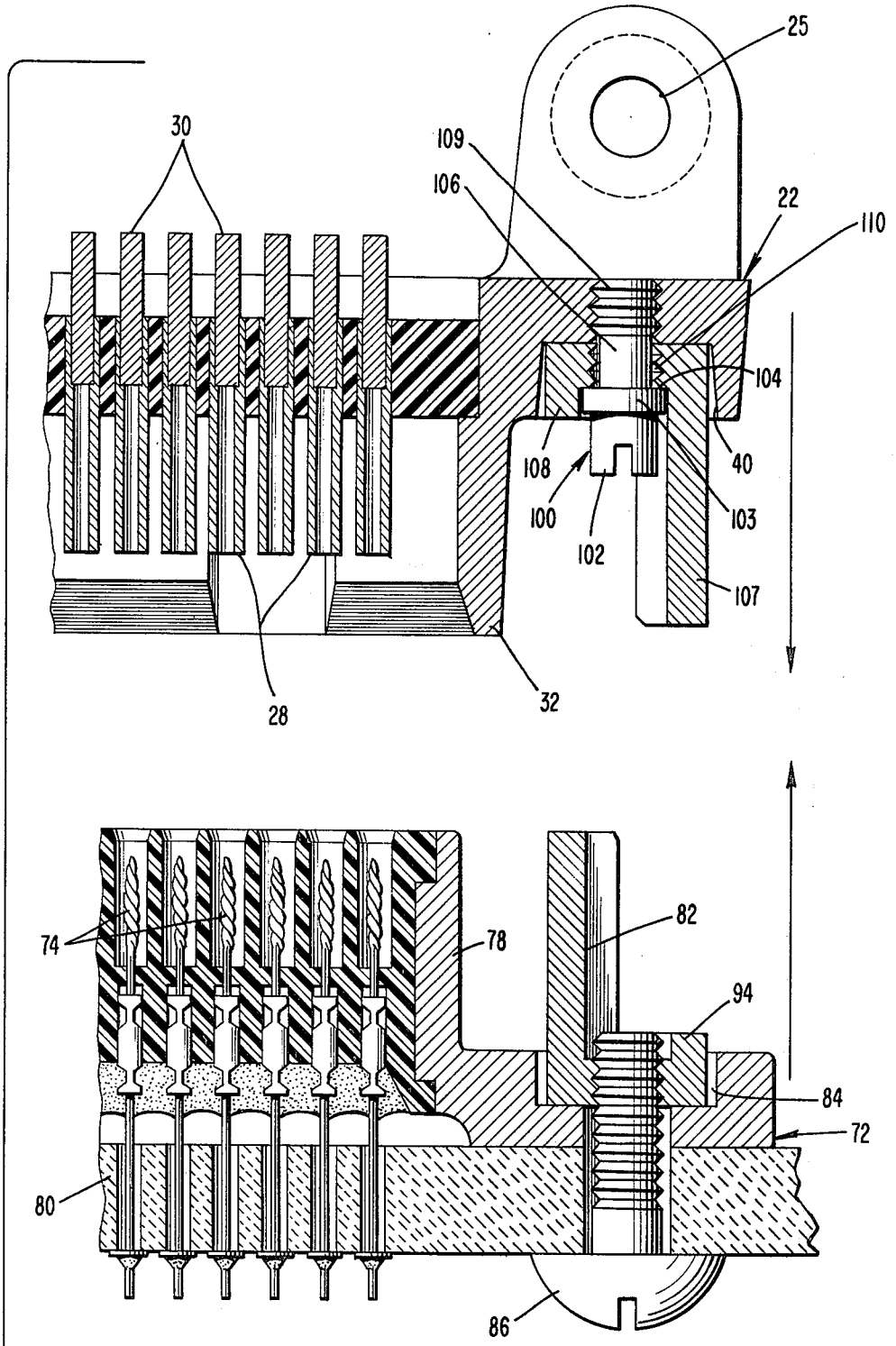
FIG. 6 is a view similar to FIG. 3 of another embodiment of the polarizing key.

As noted earlier, the retainer 100 is normally carried by the key 107 (FIG. 7 or FIG. 10). To install the key 107 onto the support member 22, the hexagonal base 108 of the key is inserted into the hexagonal depression 40 with the key oriented as desired. The retaining member 100 mounted in the base 108 is then rotated, by a screwdriver or the like, whereby the threaded stem section 109 enters the threaded bore 114 of the support member. When the shoulder 104 contacts the base 108, the key is securely mounted to the support member 22. The threads of the threaded portion 109 of the retainer are axially short enough to be disposed only within the bore 114 of the support member (i.e., externally of the bore 110) when the shoulder 104 contacts the base (FIG. 6).

To reorient the key 107, the retaining member 100 is unscrewed so that the threaded section 109 fully leaves the bore 114 of the support member 22. The key can then be removed from the depression 40, reoriented, and then re-installed by the above-described procedure. It will be appreciated that when removed from the bore 114, the retaining member remains secured to the key 107 thereby eliminating worry about its being lost or misplaced during reorientation of the key.

The provision of threads at only the outer end of the retaining member enables the latter to engage only the bore 114 when the key is secured to the support member. This eliminates opportunity for the threads to become locked as might occur if simultaneously threaded to separate bores 110, 114.

An independently significant aspect of the present invention involves the provision of cooperating leader pin and leader bushing elements 120, 122 (FIG. 11) which are suitable for use in lieu of the polarizing keys during initial testing of the electrical connectors to avoid damage to the contact assemblies. Conveniently, the leader pin 120 and leader bushing 122 are adapted to be mounted within the same cavities 40, 84 which are to receive the polarizing keys.

The leader bushing 122 comprises a circular cylindrical sleeve 124 and a threaded stem 126 projecting axially therefrom. The threads of the stem 126 are adapted to be threadedly secured within the threaded bore 114 of the support member 22.

The leader pin 120 includes an axially projecting portion 128 and a circular base 130. The diameter of the base is smaller than the shortest diametrical clearance within the hexagonal cavity 84 such that the base is loosely received in the cavity 84 and is able to "float" laterally therein to a limited extent. The leader pin 120 includes internal threads 131, enabling the pin to be secured to the connector 72 by means of a screw 132 which is loosely received within the bore 88 of the electrical connector 72 and the motherboard 80, so that the screw 132 can float along with the leader pin. Preferably, a leader pin/bushing assembly is secured at both ends of the connectors 20, 72.

In use, the leader bushing 122 is threadedly secured to the connector 20 and the leader pin 120 is loosely threadedly secured to the connector 72 by the screw 132 which is loosely received within the bore 88 of the electrical connector 72 and the motherboard 80, so that the screw 132 can float along with the leader pin. Preferably, a leader pin/bushing assembly is secured at both ends of the connectors 20, 72.

In use, the leader bushing 122 is threadedly secured to the connector 20 and the leader pin 120 is loosely threadedly secured to the connector 72 by the screw 132. The connectors 20, 72 are then carefully brought together so as to avoid damaging the contact assemblies. In so doing, the leader pin 120 enters the leader sleeve 124 and is thus automatically adjusted within the cavity 84 to a position of alignment relative to the bushing. The screw 132 is then tightened to "lock" the leader pin 120 in such position of alignment so that during subsequent test steps the connectors 20, 72 may be instantly connected, with proper alignment of the contact elements assured by the leader pin (bushing assembly).

SUMMARY OF ADVANTAGES OF THE PRESENT INVENTION

The polarizing key arrangements of the present invention provide an inexpensive and easy attachment of a key to a support member, especially an electrical edgeboard connector. The threaded retaining member 48, 100 eliminates the need for retaining pins which must be provided in holes having a diameter cut to a very small (e.g., tight or close) tolerance. Furthermore, the threaded retaining member permits the key to be inserted and removed when access is available to only one side (the key side) of the support member. Finally, since the threaded retaining member is mounted on the support member or on the key, the possibility of losing or misplacing the threaded retention member during assembly or disassembly of the key on the support member is eliminated.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A releasable polarizing arrangement for a connector which carries a support member, said polarizing arrangement comprising:

a polarizing key adapted for securement to a side of said support member, a retainer for releasably securing said key to said support member, said retainer including:

securing means for normally positively mounting said retainer to said key for rotation relative thereto while being constrained against relative axial displacement, and for positively connecting said retainer to said support member in response to rotation of said retainer to secure said key to said support member, said retainer including means accessible from said side of said support member for rotating said retainer.

2. Apparatus according to claim 1, wherein said retainer is normally mounted within a threaded bore of said key, said retainer including screw threads at an outer end thereof, said screw threads being threadably securable to a threaded bore of said support member and being short enough in axial length to be disposed externally of said threaded bore of said key when secured to said support member.

3. Apparatus according to claim 2, wherein said retainer includes a shoulder which bears against said key to press the latter against said support member.

4. Apparatus according to claim 2, wherein said key includes a polygonal periphery, said support member including a corresponding polygonal cavity for receiving said polygonal periphery.

5. Apparatus according to claim 2, wherein said accessible means comprises a tool receiving opening for receiving a tool which rotates said retainer.

6. Apparatus according to claim 2, wherein the key has an annular base portion and an axially extending portion, the axially extending portion being provided at a sector of the annular portion.

7. A releasable polarizing arrangement for a connector which carries a support member, said polarizing arrangement comprising:

a polarizing key adapted for securement to a side of said support member, a retainer for releasably securing said key to said support member, said retainer including:

securing means for normally positively mounting said retainer to said support member for rotation relative thereto while being constrained against relative axial displacement, and for positively connecting said retainer to said key in response to rotation of said retainer to secure said key to said support member, said retainer including means accessible from said side of said support member for rotating said retainer.

8. Apparatus according to claim 7, wherein the support member is provided with a bore extending completely therethrough and a countersink extending partially through the support member and wherein the retainer includes an annular flange adapted to be disposed within said countersink to prevent axial displacement of said retainer while allowing rotation thereof.

9. Apparatus according to claim 7, wherein the retainer includes a cylindrical portion having threads provided on an outer surface thereof and an axially projecting portion having a smaller diameter than the cylindrical portion, the axially projecting portion being concentrically provided on the cylindrical portion.

10. Apparatus according to claim 9, wherein said accessible means comprises a slot provided in one end of said cylindrical portion, the slot permitting the retainer to be rotated by a screwdriver.

11. Apparatus according to claim 9, wherein the retainer has a bore extending partially therethrough and wherein the axially projecting portion is deformed at an outer end to retain the retainer in a bore of the support member.

12. A releasable polarizing arrangement for a connector which includes a support portion, said polarizing arrangement comprising:

a key including a polygonal base and an axially projecting portion, said polygonal base including a threaded bore and being mountable within a corresponding polygonal cavity in one side of said support portion, a retainer including a head and a stem projecting axially therefrom, said stem normally rotatably secured within said threaded bore of said key and including screw threads adjacent an outer end thereof threadably securable within a threaded bore of said support portion, upon said retainer being rotated, to secure said key to said support portion, said screw threads being short enough in axial length to be disposed externally of said key when said key is secured to said support portion, said head of said retainer including a slot accessible from said side of said support portion to enable said retainer to be rotated by a tool.

13. An electrical edgeboard connector having a readily changeable key, comprising:

an electrical connector means having a plurality of individual electrical connectors and including a support member having a bore extending therethrough;

a key, and a threaded retainer rotatably mounted in a threaded bore of said key and threadedly securable within a threaded bore of said support member upon being rotated, said retainer including screw threads sufficiently short in axial length to be disposed externally of said threaded bore of said key when said key is secured to said support member.

14. Apparatus according to claim 13, further comprising:

second electrical connector means having a plurality of individual electrical connectors corresponding to the plurality of electrical connectors of the first-named electrical connector means, said second connector means including a second support member; and a second key mounted in a bore of said second support member and cooperable with said first-named key to properly orient said first-named and second connector means relative to each other.

* * * * *